US005865660A

United States Patent [19]

Smith

[11] Patent Number: 5,865,660

[45] Date of Patent: Feb. 2, 1999

[54] BUILDING ELEMENT

[76] Inventor: Conrad Anton Smith, 61 Coral Tree Crescent, Fourways Garden, Fourways 2055, South Africa

[21] Appl. No.: 869,622

[22] Filed: Jun. 5, 1997

[51] Int. Cl.[6] ..... A63H 33/08; A63H 3/52; E04B 1/00; C08K 91/00

[52] U.S. Cl. ..... 446/106; 446/110; 446/476; 52/284; 106/135

[58] Field of Search ..... 446/106, 110, 446/113, 114, 115, 476, 487, 488; 52/284, 591.1; 106/135

[56] References Cited

U.S. PATENT DOCUMENTS

| | | | |
|---|---|---|---|
| 1,061,637 | 5/1913 | Schwarz | 446/476 X |
| 1,883,214 | 10/1932 | Wilson et al. | 446/113 X |
| 1,910,089 | 5/1933 | Chomik | 446/114 X |
| 4,419,840 | 12/1983 | Pope | 446/110 |
| 5,281,181 | 1/1994 | McCollum | 446/106 |
| 5,580,294 | 12/1996 | Briant | 446/110 |

FOREIGN PATENT DOCUMENTS

| | | | |
|---|---|---|---|
| 132550 | 5/1949 | Australia | 446/114 |
| 383585 | 11/1932 | United Kingdom | 446/113 |
| 1219584 | 1/1971 | United Kingdom | 446/113 |

*Primary Examiner*—Kien T. Nguyen
*Assistant Examiner*—D. Neal Muir
*Attorney, Agent, or Firm*—Merchant, Gould, Smith, Edell, Welter, & Schmidt

[57] ABSTRACT

According to the present invention a building element comprises a generally planar panel defining at least one substantially straight side end and a first connecting lug extending co-planarly to the panel from the substantially straight side end. The first connecting lug extends along only a portion of said straight side end, and a slot is provided in the form of an elongate aperture extending partly into the first connecting lug or partly into the panel adjacent to the first connecting lug. The slot extends adjacent to the straight side end and parallel thereto, and the slot is open at one end thereof. The arrangement is such that two building elements with slots being open at opposite ends can be attached to each other by positioning the panels at right angles to each other and sliding the slots over each other in a direction along the straight side ends in order that the slots engage the elements. The invention also relates to structures formed by using the above elements.

12 Claims, 6 Drawing Sheets

BUILDING ELEMENT

INTRODUCTION AND BACKGROUND

This invention relates to building elements. In one embodiment of the invention it relates to building elements suitable for building scaled down structures such as, for example toy castles.

Many different kinds of building elements exist which are suitable for building scaled down structures. Many of these elements include intricate attachment formations for attaching the building elements to each other which make the building elements expensive. Some of the attachment formations are unattractive and very much visual once the building elements have been attached to each other which then detracts from the appearance of the scaled down structure.

OBJECT OF THE INVENTION

It is one object of the present invention to provide an alternative building element.

SUMMARY OF THE INVENTION

According to the present invention a building element comprises a generally planar panel defining at least one substantially straight side end; a first connecting lug extending co-planarly to the panel from the substantially straight side end, the first connecting lug extending along only a portion of said straight side end; and a slot in the form of an elongate aperture extending partly into the first connecting lug or partly into the panel adjacent to the first connecting lug the slot extending adjacent to the straight side end and parallel thereto, and the slot being open at one end thereof; the arrangement being such that two building elements with slots being open at opposite ends can be attached to each other by positioning the panels at right angles to each other and sliding the slots over each other in a direction along the straight side ends in order that the slots engage the elements.

In one embodiment of the invention the slot may extend into the first connecting lug and preferably it is open at the operatively upper end thereof. In another embodiment of the invention the slot extends into the panel and preferably it is open at the operatively lower end thereof.

In one embodiment of the invention the panel defines an operatively lower end which is substantially straight and which extends substantially at right angles from the straight side end.

In a preferred embodiment of the invention the panel is generally rectangular defining an operatively lower end, an operatively upper end opposite to the lower end and two opposite side ends extending between the upper and lower ends.

The first connecting lug is preferably located on a side end towards an operatively lower end defined by the panel and preferably the first connecting lug is provided with such a configuration that in use it gives the appearance of a buttress.

The first connecting lug may be planar and wedged shaped widening away from the panel as the first connecting lug extends towards the said operatively lower end of the panel. In a preferred embodiment of the invention the first connecting lug may be generally triangularly shaped with two sides of the triangle meeting each other at right angles and with one of said sides extending along the side end of the panel and the other said side extending in line with lower end of the panel.

In one embodiment of the invention wherein the panel defines two opposite side ends, first connecting lugs may be provided on both side ends.

The element may also include a second connecting lug extending co-planarly to the panel from the substantially straight side end of the panel and spaced apart from the first connecting lug along the said side end; and a slot in the form of an elongate aperture may be provided to extend partly into the second connecting lug adjacent to the straight side end and parallel thereto, the slot being open at one end thereof. The slot extending into the first connecting lug or partly into the panel adjacent to the first connecting lug and the slot extending into the second connecting lug may be provided in order that the open ends face in the same direction. Preferably however, the slot is provided to extend into the first connecting lug and this slot and the slot extending into the second connecting lug are provided in order that they face in opposite directions and preferably they face towards each other.

The second connecting lug may be provided with a configuration in use to give the appearance of a gargoyle.

In a preferred embodiment of the invention the panel is generally rectangular defining an operatively lower end, an operatively upper end opposite to the lower end and two opposite side ends extending between the upper and lower ends; and the first connecting lug is preferably located on a side end towards an operatively lower end defined by the panel; and the second connecting lug is located at the operatively upper end defined by the panel.

In one embodiment of the invention a first connecting lug may be provided on each side end and a second connecting lug may be provided on each side end.

The panel may also include an additional slot in the form of elongate aperture extending into the panel adjacent to the straight side end and parallel thereto at the operatively upper end thereof and opposite to the first connecting lug, this slot opening into an operatively upper end defined by the panel.

The invention also relates to a set of elements comprising at least one first building element in the form of a generally planar panel defining at least one substantially straight side end; a first connecting lug extending co-planarly to the panel from the substantially straight side end, the first connecting lug extending along only a portion of said straight side end; and a slot in the form of an elongate aperture extending partly into the first connecting lug or partly into the panel adjacent to the first connecting lug, the slot extending adjacent to the straight side end and parallel thereto, and the slot being open at one end thereof; and the set of elements further comprising at least one second element defining a panel which includes a slot therein in the form of an elongate aperture which is open at one end but the open end facing in a direction opposite to the direction in which the slot in the first building element faces to allow the said first building element to be attached to the said second element by positioning said elements at right angles to each other and sliding the slots over each other in a direction along the straight side end of the first building element in order that the slots engage the elements.

The at least one second element may comprise a building element as described hereinabove. Accordingly the at least one second element may comprise a building element comprising a generally planar panel defining at least one substantially straight side end; a first connecting lug extending co-planarly to the panel from the substantially straight side end, the first connecting lug extending along only a portion of said straight side end; and a slot in the form of an elongate aperture extending partly into the first connecting lug or partly into the panel adjacent to the first connecting lug, the slot extending adjacent to the straight side end and parallel thereto, and the slot being open at one end thereof.

Preferably, the slots in the first and second building elements are of such lengths that they allow the first connecting lugs on the first and second elements to fully overlap to provide them at the same height when the elements are in use attached to each other.

Preferably the panel of each of the at least one first building element and at least one second element is generally rectangular defining an operatively lower end, an operatively upper end opposite to the lower end and two opposite side ends extending between the upper and lower ends.

Preferably the first connecting lug of each of the first building element and second element is located at the operatively lower end defined by the panel and preferably the first connecting lug is provided with such a configuration that in use it gives the appearance of a buttress.

The first connecting lug of each of the first building element and second element may be planar and wedged shaped widening away from the panel as the first connecting lug extends towards the said operatively lower end of the panel. In a preferred embodiment of the invention the first connecting lug may be generally triangularly shaped with two sides of the triangle meeting each other at right angles and with one of said sides extending along the side end of the panel and the other said side extending in line with lower end of the panel.

In one embodiment of the invention wherein the panel defines two opposite side ends, first connecting lugs may be provided on both side ends.

The first element may also include a second connecting lug extending co-planarly to the panel from the substantially straight side end of the panel and spaced apart from the first connecting lug along the said side end; and a slot in the form of an elongate aperture extending partly into the second connecting lug adjacent to the straight side end and parallel thereto, the slot being open at one end thereof; and the second element may include an additional slot in the form of an elongate aperture extending adjacent to the straight side end and parallel thereto, the additional slot being open at one end thereof; and the arrangement being such that when the panels of the first and second elements are positioned at right angles to each other the slot in the second connecting lug on the first element and the additional slot in second element are slid over each other in a direction along the straight side ends to engage the second connecting lug to the second element.

The second connecting lug may be provided with a configuration in use to give the appearance of a gargoyle.

The additional slot of the second element may be provided in a second connecting lug extending co-planarly to the panel from the substantially straight side end of the panel and spaced apart from the first connecting lug along the said side end. Alternatively and preferably the additional slot of the second element may be provided directly into the panel of that element.

The slots in the first connecting lug and second connecting lug located at the same side end of the first element may be provided in order that the open ends face in the same direction. The slot in the first connecting lug and additional slot located at the same side end of the second element may be provided in order that the open ends face in the same direction.

In a preferred embodiment of the invention the slot is provided in the first connecting lug of the first element, and the slots provided in the first and second connecting lug located at the same side end of the first element may be provided in order that the open ends face in opposite directions but preferably towards each other. The slot may be provided to extend into the panel adjacent to the first connecting lug of the second element and the said slot and the additional slot located at the same side end of the second element may be provided in order that the open ends face in opposite directions, but preferably away from each other.

The first connecting lug of the first element is preferably located on a side end towards an operatively lower end defined by the panel; and the second connecting lug is located at the operatively upper end defined by the panel.

The set may also include other panels which are attachable to each other or to the building elements.

The set of elements may be suitable to build scaled down structures, such as housing structures and preferably toy castles. Some of the panels in the set may include apertures therethrough defining door and/or window openings.

The building elements may be made of any suitable sheet material such as a polymeric material, wood or a paper based material. Preferably the sheet material is rigid to the extent that it does not fold under its own weight when held in an upright position.

According to another aspect of the present invention there is provided a structure formed by using the building elements described hereinabove.

According to yet another aspect of the invention there is provided a structure formed by using at least one set of elements described hereinabove.

According to another aspect of the present invention there is provided the use of building elements or at least one set of elements described hereinabove to build structures.

Without thereby limiting the scope of the invention and by means of example only, embodiments of the invention will now be further described with reference to the accompanying drawings wherein:

DESCRIPTION OF THE DIAGRAMS

In the accompanying drawings the same reference numerals are used to denote corresponding parts.

DESCRIPTION OF PREFERRED EMBODIMENTS OF THE INVENTION

Figure 1:
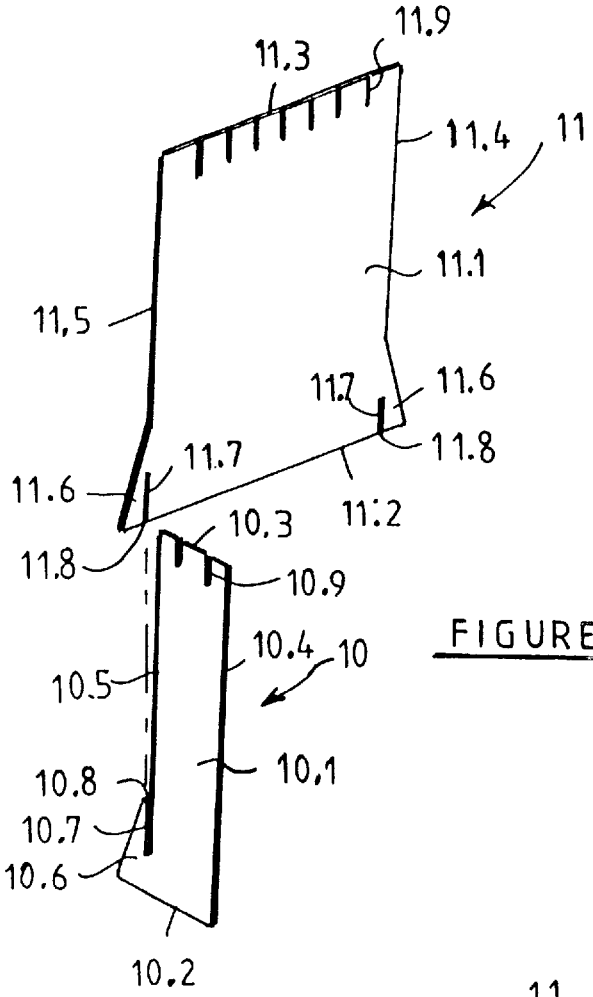
FIG. 1 is an exploded perspective view of two building elements according to the invention.
Figure 2:
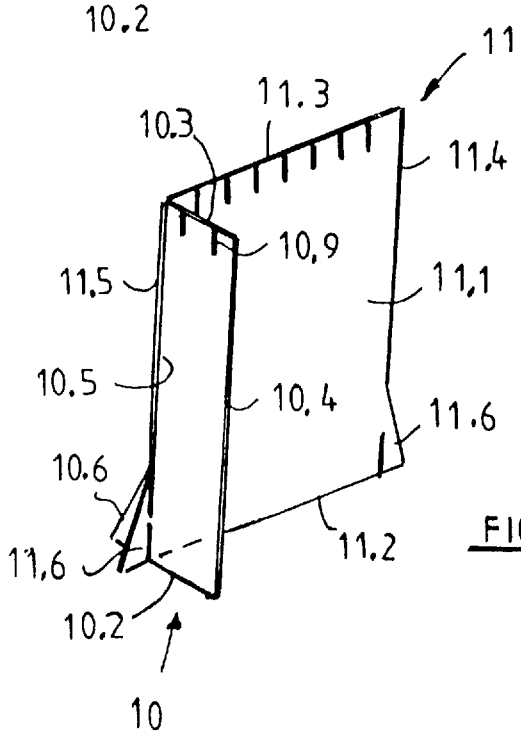
FIG. 2 is an assembled perspective view of the two building elements of FIG. 1.

Referring now to FIGS. 1 and 2 a building element 10 comprises a generally planar and rectangular panel 10.1 defining an operatively lower end 10.2, an operatively upper end 10.3 opposite to the lower end 10.2 and two opposite straight side ends 10.4 and 10.5 extending between the upper and lower ends 10.3 and 10.2 respectively. A first connecting lug 10.6 extends co-planarly to the panel 10.1 from the side end 10.5 thereof, the first connecting lug 10.6 extending along a portion of the said side end 10.5. A slot 10.7 in the form of an elongate aperture extends partly into the first connecting lug 10.6 adjacent and parallel to the side end 10.5. The slot 10.7 is open at one end, which is the operatively upper end 10.8 thereof.

The building element 11 is very similar to the building element 10 and also comprises a generally planar and rectangular panel 11.1 defining an operatively lower end 11.2, an operatively upper end 11.3 opposite to the lower end 10.2 and two opposite straight side ends 11.4 and 11.5 extending between the upper and lower ends 11.3 and 11.2 respectively. Two first connecting lugs 11.6 extend co-planarly to the panel 11.1 from the side ends 11.4 and 11.5, the first connecting lugs 11.6 extending along only a portion of each of the side ends 11.4 and 11.5. A slot 11.7 in the form of an elongate aperture extends partly into the panel 11.1 adjacent to each first connecting lug 11.6, the slots 11.7 extending adjacent and parallel to the side ends 11.4 and 11.5 respectively. Each slot 11.7 is open at one end which is the operatively lower end 11.8 thereof.

The slots 11.7 extend in an opposite direction to the slot 10.7 since the open ends 11.8 and 10.8 face in opposite directions, thereby allowing the building elements 10 and 11 to be attached to each other by positioning the panels 10.1 and 11.1 at right angles to each other and then sliding the panel 11 from a position above the panel 10 and along the side ends 10.5 and 11.5 in order that the slots 11.7 and 10.7 slide over each other in order that they engage the elements 10 and 11 respectively. The slots 11.7 and 10.7 are of such lengths to that they allow the connecting lugs 11.6 and 11.7 to fully overlap to provide them at the same height when the elements 10 and 11 are attached to each other as shown in FIG. 2.

The building elements 10 and 11 define a pair of inter-connectable building elements.

The first connecting lug 10.6 is located at the lower end 10.2 of the panel 10 and in use it gives the appearance of a buttress when the elements 10 and 11 are connected to each other.

The first connecting lug 10.6 is planar and wedged shaped widening away from the panel 10.1 as the lug 10.6 extends towards the lower end 10.2 of the panel 10.1. The first connecting lug 10.6 is triangularly shaped with two sides of the triangle meeting each other at right angles and with one of said sides extending along the side end 10.5 and the other side extending in line with the lower end 10.2.

The first connecting lugs 11.6 are similarly positioned and shaped as the first connecting lug 10.6.

The building elements 10 and 11 include slots 10.9 and 11.9 in their respective upper ends 10.3 and 11.3. These slots 10.9 and 11.9 are ornamental in character to provide the appearance of shooting slots provided in castle walls.

The building elements 10 and 11 may be made of any suitable sheet material such as for example press-board or a polymeric material.

Figure 3:
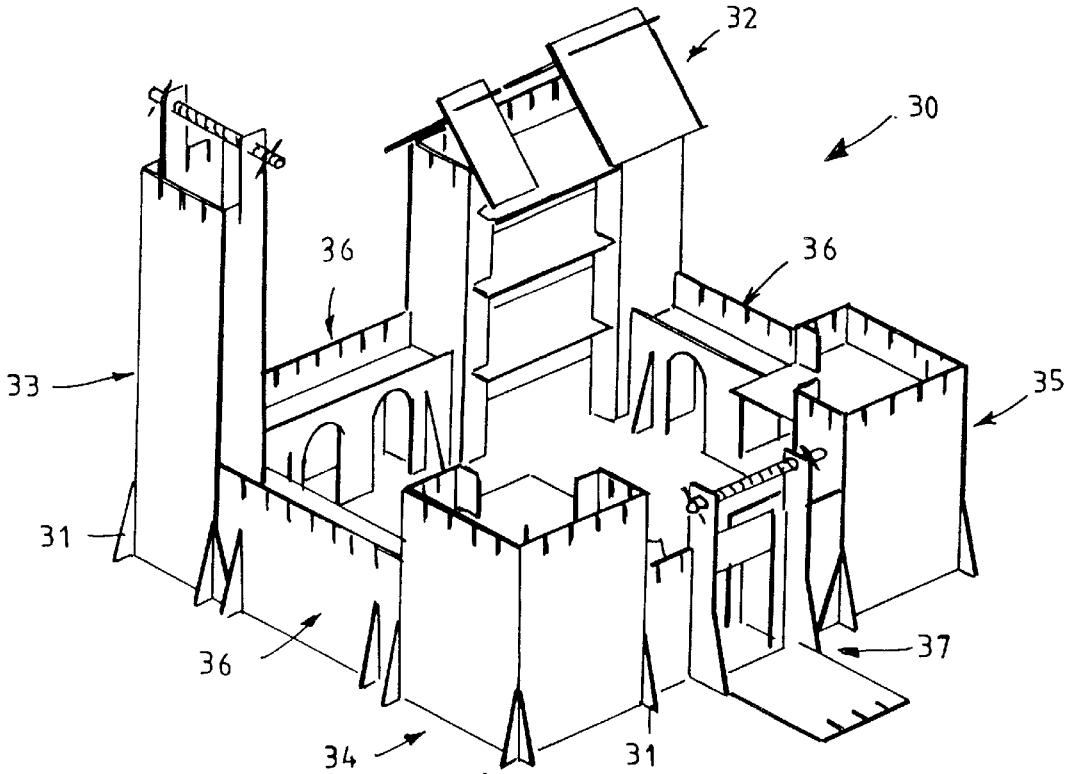
FIG. 3 is a perspective view of a scaled down castle constructed from planar panels attached to each other with some of the panels comprising building elements according to the invention.

Referring now to FIG. 3 there is shown a scaled down castle 30 constructed from an inter-connected set of elements and wherein some of the elements are building elements according to the invention thereby providing buttress-shaped lugs 31 to the castle 30 which lugs 31 contribute to the appearance of the castle 30. The other elements do not include lugs 31 but most of them include slots of similar nature as slots 10.7 and 11.7 allowing said elements to inter-engage each other or to inter-engage the building elements according to the invention.

Figure 4:
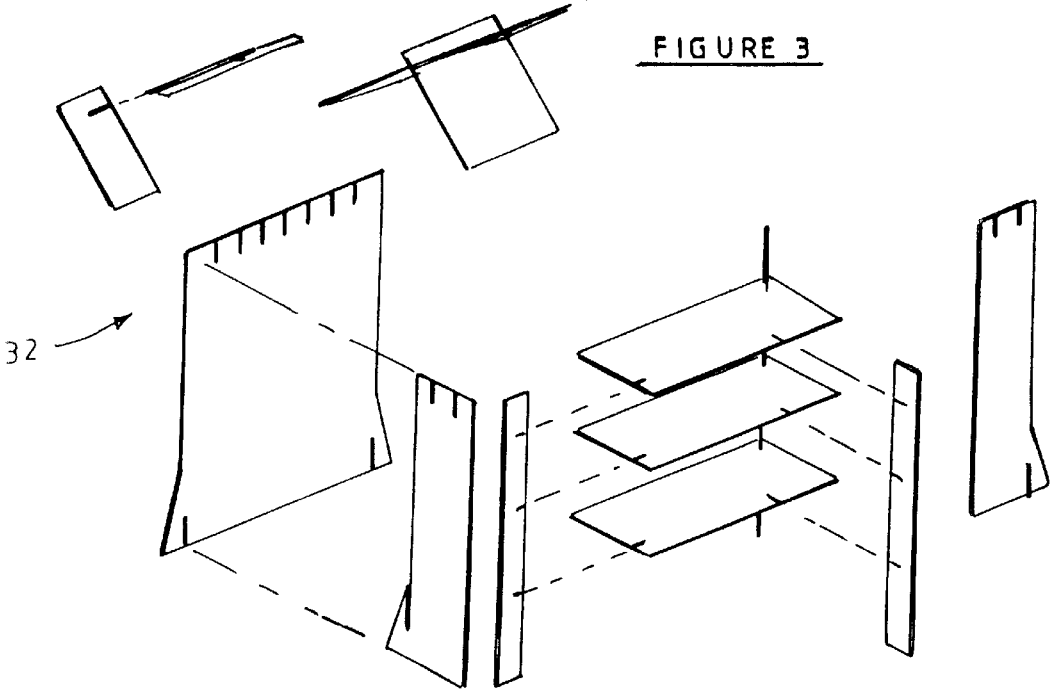
FIGS. 4 to 8 are exploded perspective views of parts of the castle of FIG. 3.
Figure 5:
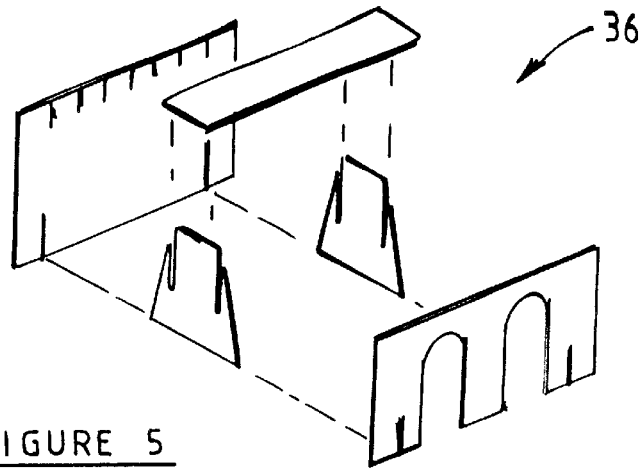
Figure 6:
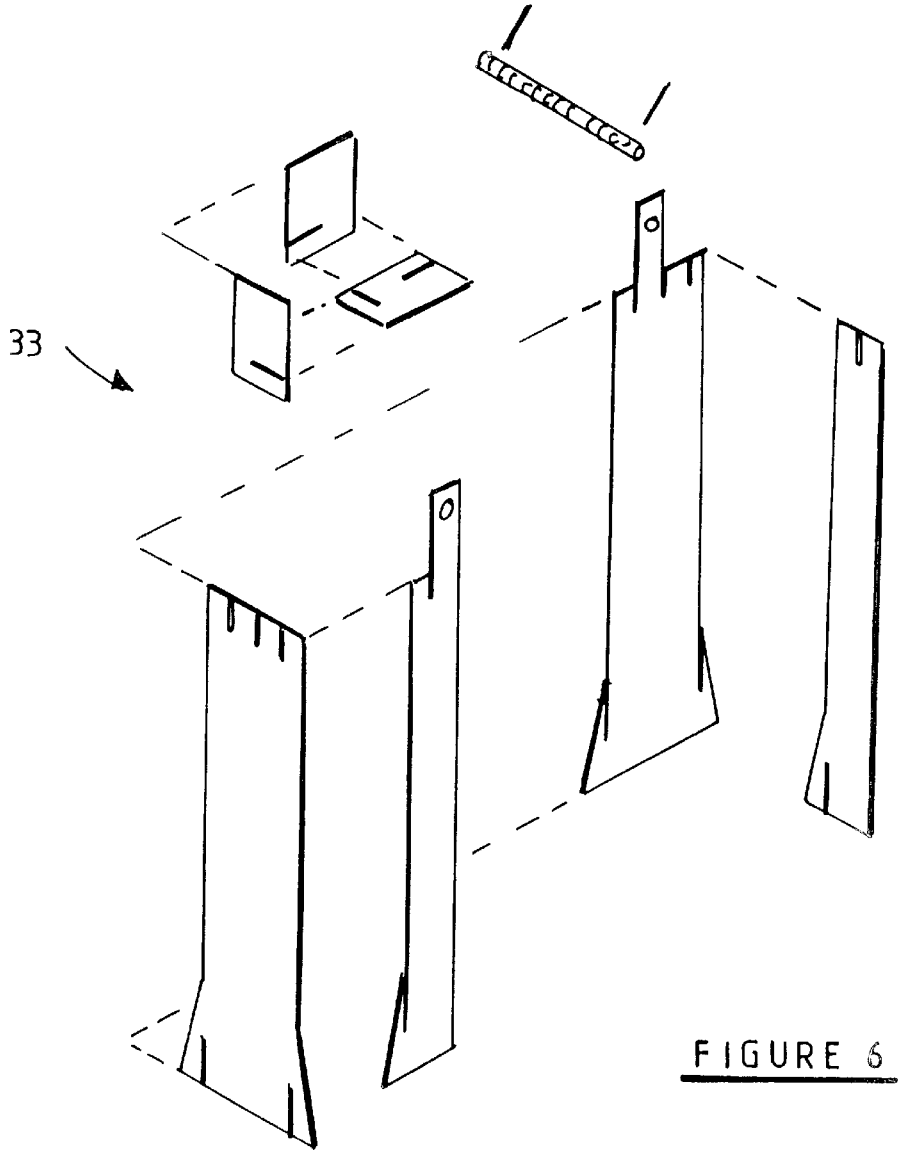
Figure 7:
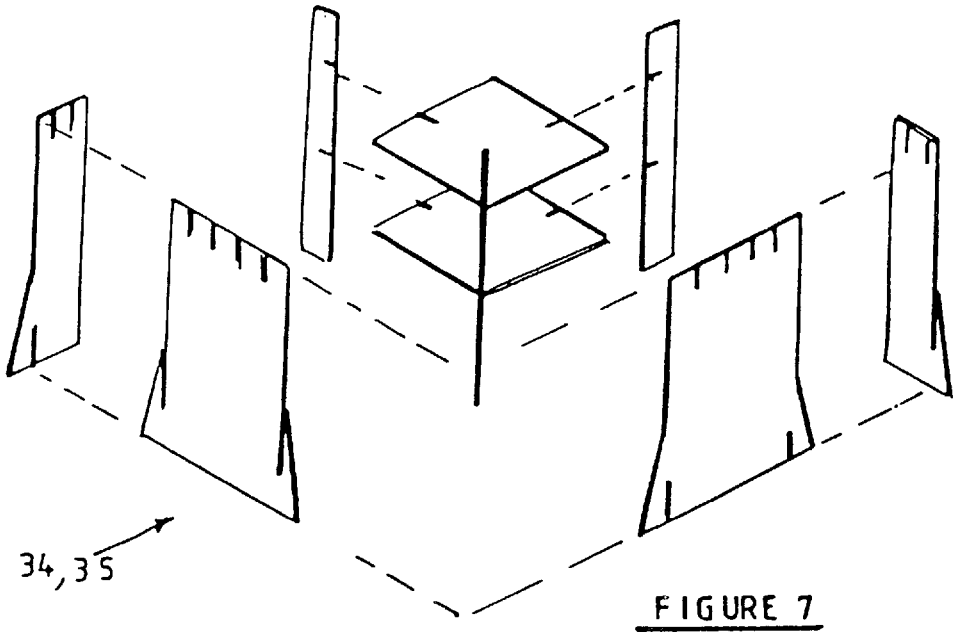

The castle 30 includes four towers 32, 33, 34 and 35 and exploded perspective views of these towers are shown in FIGS. 4, 6 and 7. The castle 30 also defines inter-connecting walls and passageways 36 between the above-mentioned towers which are shown in an exploded perspective configuration in FIG. 5.

Figure 8:
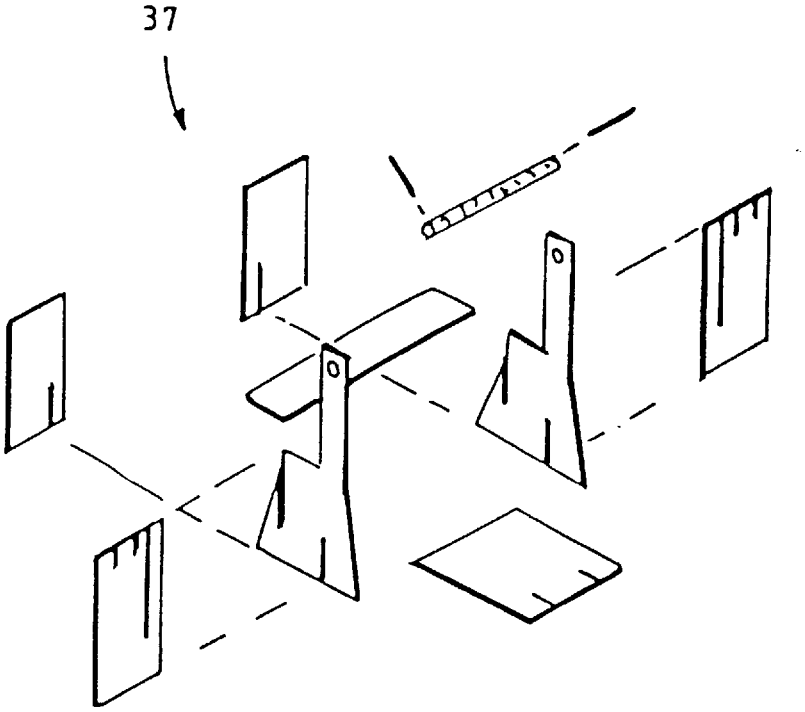

The gate construction 37 of the castle 33 is shown in an exploded perspective configuration in FIG. 8.

The parts and the construction of the castle 30 is clearly shown in FIGS. 3 to 8 and no further description thereof is required.

Figure 9:
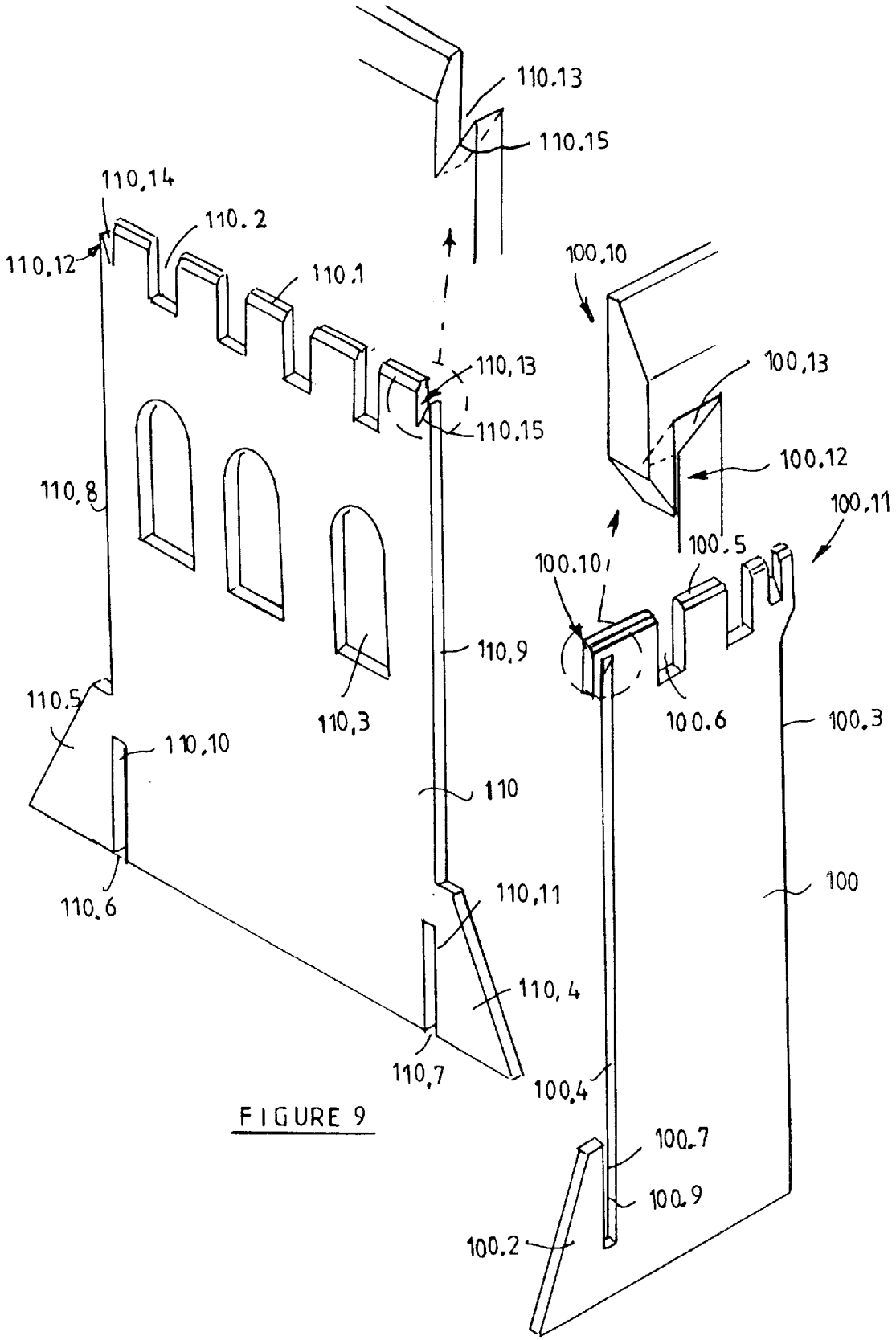
FIG. 9 is an exploded perspective view of two building elements according to another embodiment of the invention.
Figure 11:
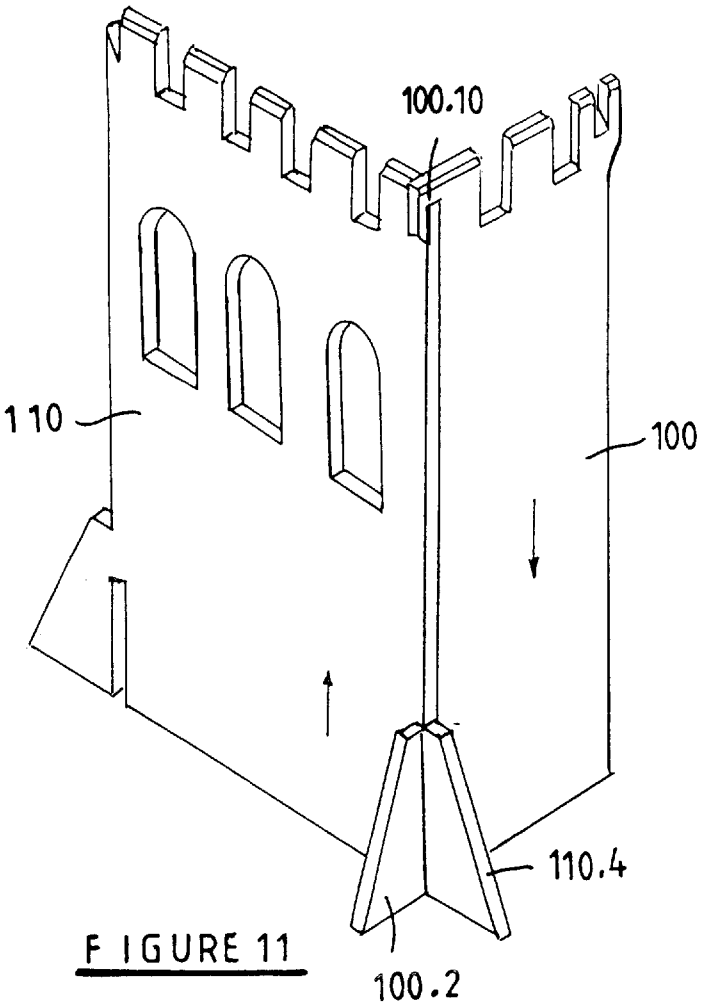
FIG. 11 is a fully assembled perspective view of the two building elements of FIG. 9.
Figure 10:
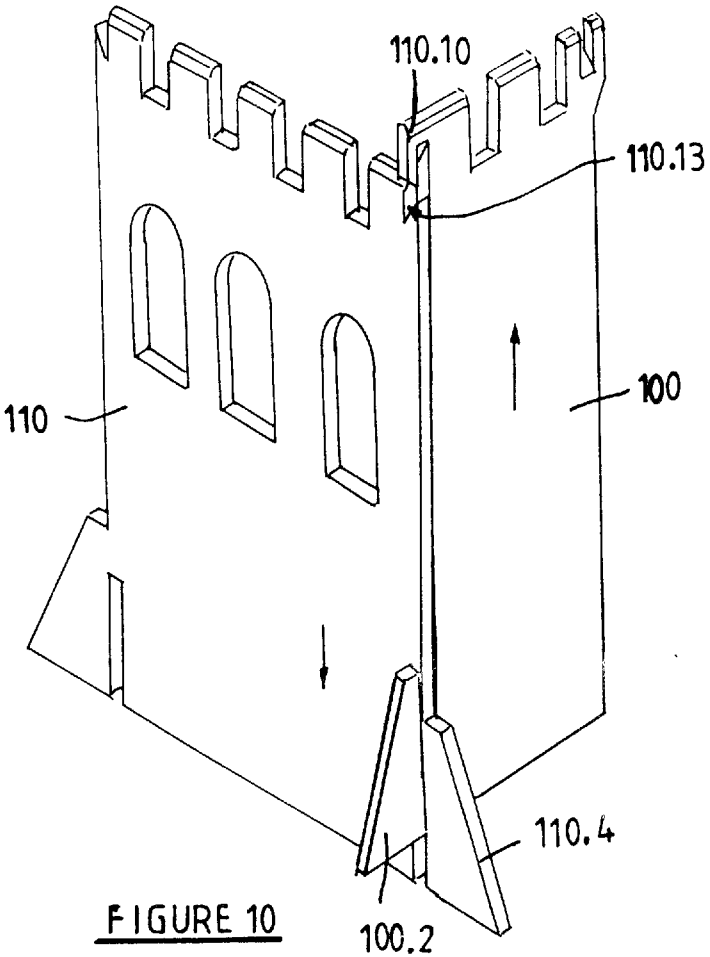
FIG. 10 is a partly assembled perspective view of the two building elements of FIG. 9.

Referring now to FIGS. 9 to 11 building elements 100 and 110 are similar to elements 10 and 11. In this case the panel 100 includes a first connecting lug 100.2 a side end 100.4. The operatively upper ends 100.5 and 110.1 of the elements 100 and 110 are bevelled and the slots 100.6 and 110.2 are wider than those of elements 10 and 11. The element 110 also include window opening formations 110.3. The first connecting lug 100.2 of the element 100 and the first connecting lugs 110.4 and 110.5 are also generally triangularly shaped but are truncated at their operatively upper ends.

As shown in FIG. 9 the slot 100.7 in element 100 is not directly in line with the side end 100.4 but slightly off-set to the operatively outside of said side end 100.4 to extend into the lug 100.2 with the inside leg 100.9 being directly in line with the side end 100.4. Similarly the slots 110.6 and 110.7 are not directly in line with the side ends 110.8 and 110.9 respectively but slightly off-set to the operatively inside thereof to extend into the panel 110 in order that the outside legs 110.10 and 110.11 are directly in line with the side ends 110.8 and 110.9 respectively. This arrangement ensures that the side end 100.4 is in use received against the element 110 directly adjacent to the side end 110.9 to form a neat junction.

The slots 10.7 and 11.7 in the elements 10 and 11 are made in a similar way as described above.

The major difference between elements 100 and 110 on the one side and 10 and 11 on the other side is that second connecting lugs 100.10 and 100.11 are provided on the element 100 and additional slots 110.12 and 110.13 are provided in the element 110.

The second connecting lugs 100.10 and 100.11 extend co-planarly to the element 100 from the side ends 100.4 and 100.3 respectively. The second connecting lugs 100.10 and 100.11 are provided at the operatively upper end 100.5 of the element 100 and the second connecting lug 100.10 is spaced apart from the first connecting lug 100.2 along the side end 100.4. The second connecting lugs may be provided with configurations in use to provide the appearance of a gargoyle.

The second connecting lug 100.10 includes a slot 100.12 therein in the form of an elongate aperture extending partly into the lug 100.10 adjacent to the straight side end 100.4 and parallel thereto, the slot 100.12 being open at the operatively lower end thereof, with the open end facing the open end of the slot 100.7. The closed end 100.13 of the slot 100.12 is slanted as shown. The second connecting lug 100.11 is generally similar to the lug 100.10 but the slot therein opens into the opposite direction as slot 100.12. In use additional panels (similar to those shown in for example FIG. 4) received within the panels 100 and 110 may be provided with suitable formations [not shown] to engage the lug 100.11

The additional slots 110.12 and 110.13 are in line with the slots 110.6 and 110.7 respectively. The one side 110.14 and

110.15 respectively of slots 110.12 and 110.13 are slanted and shorter than the other side of the said slots to snugly engage slanted ends such as ends 100.13 in lug 100.10.

In use the elements 100 and 110 are engaged to each other as shown in FIGS. 10 and 11 and the engagement provided by the additional slot 110.13 and second connecting lug 100.10 provide additional stability to the attachment.

The building elements can also be used in various combinations to build other scaled down structures. Complex dwellings such as cathedrals, abbeys etc. may be formed but simple dwellings such as a serf's hut can also be formed. The building elements may also be textured to improve the appearance of the structure formed.

I claim:

1. A set of elements suitable for building a scaled down structure comprising:

at least one first building element in the form of a generally planar panel defining at least one substantially straight side end and an operatively lower end which extends substantially at right angles from the side end; a first connecting lug extending co-planarly to the panel from the substantially straight side end, the first connecting lug extending along only a portion of said substantially straight side end towards the operatively lower end; a first slot at the first connecting lug, the first slot being in the form of an elongate aperture extending adjacent to the straight side end and parallel thereto, and the slot being open at one end thereof; a second connecting lug extending co-planarly to the panel from the substantially straight side end of the panel and spaced apart from the first connecting lug along the said side end, towards the operatively upper end; a second slot at the second connecting lug, the second slot being in the form of an elongate aperture extending adjacent to the straight side end and parallel thereto, the second slot being open at one end thereof and the open ends of the first slot and second slot facing in opposite directions;

and the set of elements further comprising at least one second element comprising a generally planar panel defining at least one substantially straight side end, an operatively lower end which extends substantially at right angles from the side end; a third connecting lug extending co-planarly to the panel from the substantially straight side end, the third connecting lug extending along only a portion of said straight side end towards the operatively lower end; a first slot at the third connecting lug, the first slot being in the form of an elongate aperture extending adjacent to the straight side end and parallel thereto, and the slot being open at one end thereof, but the open end facing in a direction opposite to the direction in which the first slot in the first building element faces to allow the said first building element to be attached to the said second element by positioning said elements at right angles to each other and sliding the slots over each other in a direction along the straight side end of the first building element in order that the slots engage the elements; the second element including an additional slot in the form of an elongate aperture extending adjacent to the straight side end and parallel thereto, the additional slot being open at one end thereof and the ends of the first slot on the second element and additional slot facing in opposite directions; and the arrangement being such that when the panels of the first and second elements are positioned at right angles to each other the slot at the second connecting lug on the first element and the additional slot in said second element are slid over each other in a direction along the straight side ends to engage the second connecting lug to the second element when said operative lower ends are co-planar.

2. The set of claim 1, wherein the first slots in the first and second elements are of such lengths that they allow the first connecting lug on the first element and the third connecting lug on the second element to fully overlap to provide them at the same height when the elements are in use attached to each other.

3. The set of claim 2, wherein the panel of each of the at least one first building element and the at least one second element is generally rectangluar, defining an operatively lower end, an operatively upper end opposite to the lower end and two opposite side ends extending between the upper and lower ends.

4. The set of claim 1, wherein the first connecting lug of the first building element and the third connecting lug of the second element are located at the operatively lower ends defined by the panels; and the first connecting lug and the third connecting lug being provided with such a configuration that in use it gives the appearance of a buttress.

5. The set of claim 1, wherein the additional slot of the second element is provided directly into the panel of the element.

6. The set of claim 5, wherein the one side of the additional slot slants from the substantially straight side end of the panel into the panel and the second slot in the first panel defining a slanted bottom which in use matingly engages the slanted side of the additional slot.

7. The set of claim 1, wherein the first slot is provided in the first connecting lug of the first element, and the second slot is provided in the second connecting lug located at the same side end of the first element, wherein the open ends of said slots face in opposite directions and towards each other.

8. The set of claim 7, wherein the first slot is provided to extend into the panel adjacent to the third connecting lug of the second element and the said first slot and the additional slot located at the same side end of the second element are provided in order that the open ends face in opposite directions, and away from each other.

9. The set of claim 1, wherein the first connecting lug of the first element is located on a side end at the operatively lower end defined by the panel; and the second connecting lug is located at an operatively upper end defined by the panel.

10. The set of claim 1, wherein the set is suitable for building scaled down housing structures.

11. A scaled down structure built by using at least one set of elements of any one of the preceding claims.

12. The use of at least one set of elements of any one of claims 1–10 to build scaled down structures.

* * * * *